US005680160A

United States Patent [19]

LaPointe

[11] Patent Number: 5,680,160

[45] Date of Patent: Oct. 21, 1997

[54] TOUCH ACTIVATED ELECTROLUMINESCENT LAMP AND DISPLAY SWITCH

[75] Inventor: Bradley J. LaPointe, Shorewood, Minn.

[73] Assignee: Leading Edge Industries, Inc., Minnetonka, Minn.

[21] Appl. No.: 388,061

[22] Filed: Feb. 9, 1995

[51] Int. Cl.[6] ..... G08C 1/00

[52] U.S. Cl. ..... 345/173; 345/76

[58] Field of Search ..... 345/76, 80, 173, 345/174; 313/508, 502, 501, 498, 506, 509; 315/169.3

[56] References Cited

U.S. PATENT DOCUMENTS

| | | | |
|---|---|---|---|
| 4,017,848 | 4/1977 | Tannas, Jr. | 345/173 |
| 4,532,395 | 7/1985 | Zukowski | 200/314 |
| 4,683,360 | 7/1987 | Maser | 200/314 |
| 4,740,781 | 4/1988 | Brown | 340/712 |
| 4,743,895 | 5/1988 | Alexander | 345/174 |
| 4,758,830 | 7/1988 | Levien et al. | 340/712 |
| 4,893,115 | 1/1990 | Blanchard | 345/174 |
| 5,317,488 | 5/1994 | Penrod | 362/84 |

FOREIGN PATENT DOCUMENTS

| | | | |
|---|---|---|---|
| 7-029453 | 1/1995 | Japan | H01H 13/70 |

*Primary Examiner*—Wendy Garber
*Attorney, Agent, or Firm*—Michael J. Weins

[57] ABSTRACT

The present invention is for touch activated electroluminescent lamps and displays having a flexible translucent or transparent substrate, a transparent electrode deposited onto the flexible transparent substrate, a phosphor layer over the transparent electrode, a dielectric layer over the phosphor layer, and a second electrode, which together form a lamp. A third electrode is separated from the second electrode by an insulating spacer having an open region configured to allow contact between the second electrode and the third electrode when pressure is applied to the flexible transparent substrate. For a touch activated display, a segmented second electrode is employed to allow selectively energizing regions of the display. In a two-staged embodiment, a fourth electrode is separated from the third electrode by an insulating sheet, and a fifth electrode is separated from the fourth electrode by a second insulating spacer which has a second open region therein, which is configured to allow contact between the fourth electrode and the fifth electrode when additional pressure is applied to the flexible transparent substrate.

13 Claims, 7 Drawing Sheets

Figure 4

Figure 5

TOUCH ACTIVATED ELECTROLUMINESCENT LAMP AND DISPLAY SWITCH

FIELD OF THE INVENTION

The present invention relates to a switch and more particularly to a touch sensitive switch for electroluminescent lamps and displays.

BACKGROUND OF THE INVENTION

There have been various patents which teach the use of a touch sensitive switch in combination with an electroluminescent lamp. Early switch and electroluminescent lamp combinations employed a switch located behind the lamp. The switch was activated by depressing the screen to trip the switch that was positioned therebehind. The resulting lamp and switch combination required separate fabrication of a switch and a lamp. These early switch and electroluminescent screen combinations employed the electroluminescent lamp to provide a lighted switch, to help the user locate the switch.

An integrated electroluminescent lamp and switch combination is taught in U.S. Pat. No. 4,532,395. While the structure taught therein provides an integrated structure, which simplifies the fabrication, the electroluminescent lamp and switch combination of the '395 patent has a multiplicity of layers, adding to the cost and complexity of fabricating the electroluminescent lamp and switch combination. The switch of the '395 patent is used behind an electroluminescent lamp and does not serve to activate the lamp but, rather, helps one identify the location of the switch. While the switch of the '395 patent could be employed to energize the screen, to do so would require additional circuits.

In addition to contact switches being used in combination with an electroluminescent screen, capacitance type switches have been employed, such as taught in U.S. Pat. No. 4,758,830.

These switches are activated by changing the spacing between electrodes, measuring the change in capacitance, and using this change to trigger a switch. While the structure of such switches is simple, and activation is not dependent on contact of a pair of electrodes, the activation requires circuity not required by a contact switch.

Thus, there is a need for a touch activated lamp or display with a simple structure suitable for production by screen printing.

OBJECTS OF THE INVENTION

It is an object of the invention to provide an electroluminescent lamp or display which is touch sensitive and can be energized by touching.

It is another object of the invention to provide a touch sensitive electroluminescent lamp or display which can withstand bending without energizing the lamp.

It is yet another object of the invention to provide a touch sensitive electroluminescent lamp or display and switch combination which is multi-functional, where several functions can be sequentially activated by providing an increasing pressure.

It is a further object of the invention to provide a touch sensitive electroluminescent lamp or display and switch combination which is multi-functional, with the first function of the switch, being to energize the lamp.

It is still another object of the invention to provide an electroluminescent lamp or display and switch combination which can be readily fabricated by screen printing.

It is still a further object of the invention to provide an electroluminescent lamp or display which is touch activated by a contact type switch with a reduced number of layers.

It is another object of the invention to provide a switch, which can be used to energize an electroluminescent lamp or display, which does not require external switching circuits.

It is yet a further object of the invention to provide a touch sensitive electroluminescent display which provides an interactive display.

Another object of the invention is to provide a switch which will provide notice that additional pressure will result in activating the device to which it is connected.

SUMMARY OF THE INVENTION

The present invention in its simplest form is an internal switch for touch activated electroluminescent lamps and displays. For the purpose of the present invention, a lamp will be defined as a single light source device, while a display will be defined as a multiple light source device. A lamp of the present invention has a flexible translucent or transparent substrate, such as a MYLAR® sheet. Hereinafter the term transparent will be used to collectively describe any material that will transmit light, whether the material is transparent or translucent. A transparent electrode is deposited onto the flexible transparent substrate. A phosphor layer overlays the transparent electrode. In turn, a dielectric layer such as barium titanate overlays the phosphor layer, and is interposed between the phosphor layer and a second electrode. The transparent substrate, the transparent electrode, the phosphor layer, the dielectric layer and the second electrode form a lamp which can be lighted by applying a potential across the phosphor layer, causing luminescence of the phosphor layer.

The touch activated lamp of the present invention has a third electrode, which is separated from the second electrode by an insulating spacer having an open region configured to allow contact between the second electrode and the third electrode when pressure is applied to the flexible transparent substrate.

It is preferred that the insulating spacer have a frame with a central opening, and further preferred that the central opening contain an array of isolated insulating bodies mounted on the third electrode.

It is further preferred that the array of isolated insulating bodies, which are affixed to the third electrode, be contoured so as to provide a smooth surface of contact between the insulating bodies and the second electrode when the second electrode is brought into contact with the third electrode.

In situations where the lamp or display is large, it is further preferred that the array of isolated insulating bodies is uniformly distributed on the third electrode. One preferred spacial distribution of the insulating bodies is a matrix defined by a first set of parallel lines and a second set of parallel lines, and it is further preferred that the first set of parallel lines be orthogonal to the second set of parallel lines. Such a configuration has been found effective in providing uniformity in response of the lamp to pressure, independent of the point of application of the force.

When a touch activated display is desired, such can be obtained by employing a segmented second electrode, to allow selectively energizing regions of the display. In such a case, the segmented second electrode will have at least a first electrode segment, bounded by a first peripheral edge, and a second electrode, segment bounded by a second peripheral edge.

It is further preferred for a touch activated display that insulating ridges, which are attached to the third electrode, be provided. These insulating ridges are aligned with the peripheral edges of the segmented second electrode.

It is further preferred, to enhance the definition of the display, to have the phosphor layer be divided into phosphor layer segments which are coincident with the electrode segments.

The above described lamps and displays are well suited to be combined with conventional switches of either the contact type or the capacitance type. The switch of the present invention offers an advantage over touch activated switches such as taught in the '395 patent in that it first lights, and only with increased pressure trips the second switch.

It should also be appreciated that the touch sensitive lamps and displays as discussed above can serve as switches, by having a sensing circuit that activates a relay which serves as a switch.

BEST MODE OF CARRYING THE INVENTION INTO PRACTICE

Figure 1:
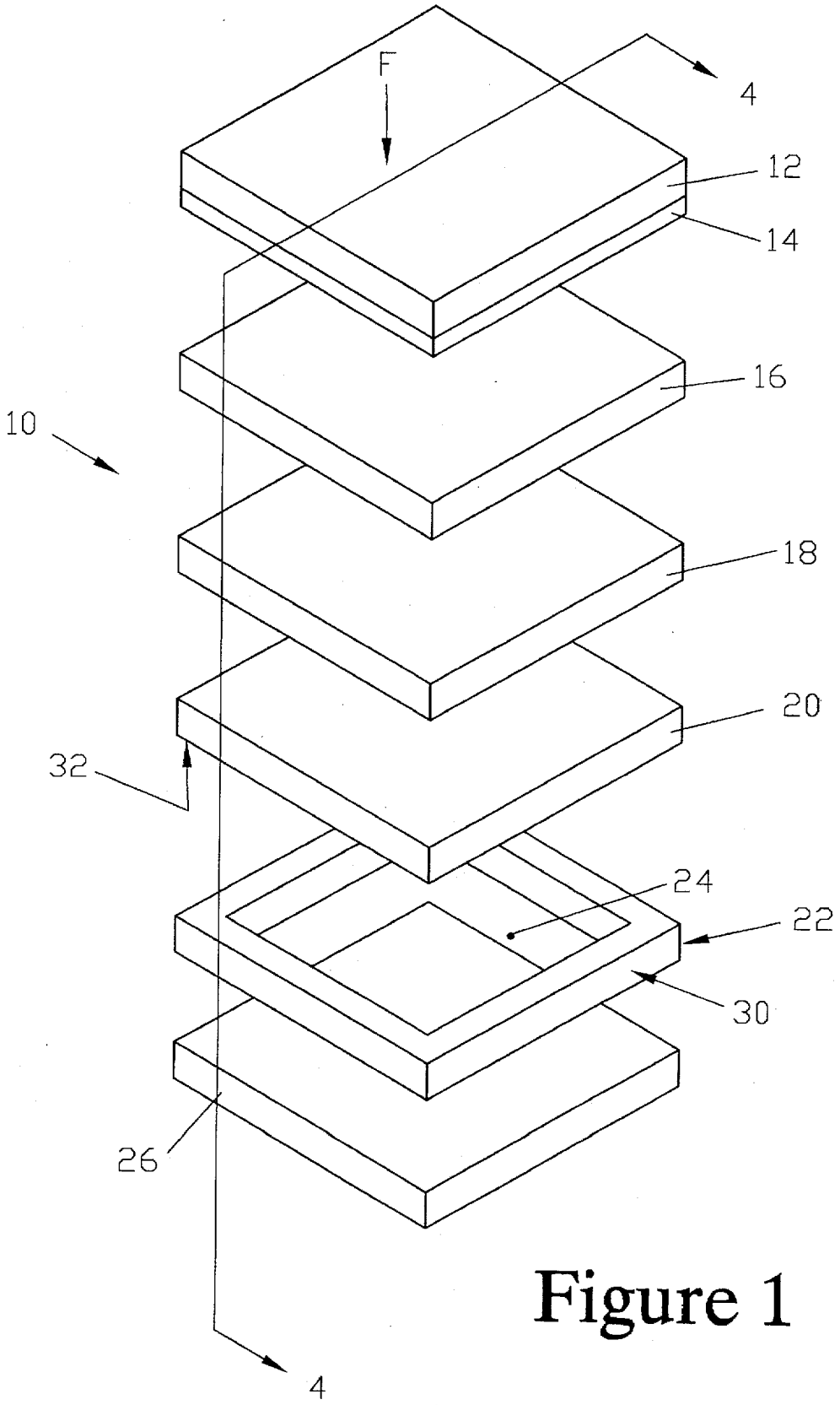
FIG. 1 illustrates one embodiment of a touch activated electroluminescent lamp of the present invention, which is shown in a partially exploded isometric view.

FIG. 1 is a partially exploded isometric view of one embodiment of the present invention, illustrating a touch activated electroluminescent lamp 10. The touch activated electroluminescent lamp 10 is well suited for fabrication by screen printing, and the discussion of it and its fabrication will be in terms of screen printing. The touch sensitive electroluminescent lamp 10 has a flexible transparent substrate 12, which is preferably a polymer film such as MYLAR®. These films are commercially available with a transparent electrode 14 deposited thereon. A phosphor layer 16 is printed onto the transparent electrode 14. A dielectric layer 18, such as barium titanate, is printed on the phosphor layer 16. Onto the dielectric layer 18 is printed a second electrode 20. The above described elements are the elements which are typically employed to provide an electroluminescent lamp. The phosphor layer 16 will luminesce, providing light in the visible range, when a voltage gradient is established in the phosphor layer 16 by a potential generated between the transparent electrode 14 and the second electrode 20.

An insulating spacer 22 having an open region 24 is located between the second electrode 20 and a third electrode 26. The insulating spacer 22 is provided to maintain separation between the second electrode 20 and the third electrode 26. The insulating spacer 22 of the embodiment of FIG. 1 is a frame 30, which is deposited onto the third electrode 26 and, in turn, is bonded to the second electrode 20 in the vicinity of its peripheral edge 32. The frame 30 will prevent contact between the second electrode 20 and the third electrode 26 until a force F is applied to the transparent substrate 12, of sufficient magnitude to cause the second electrode 20 to deform, bringing it into contact with the third electrode 26.

Figure 2:
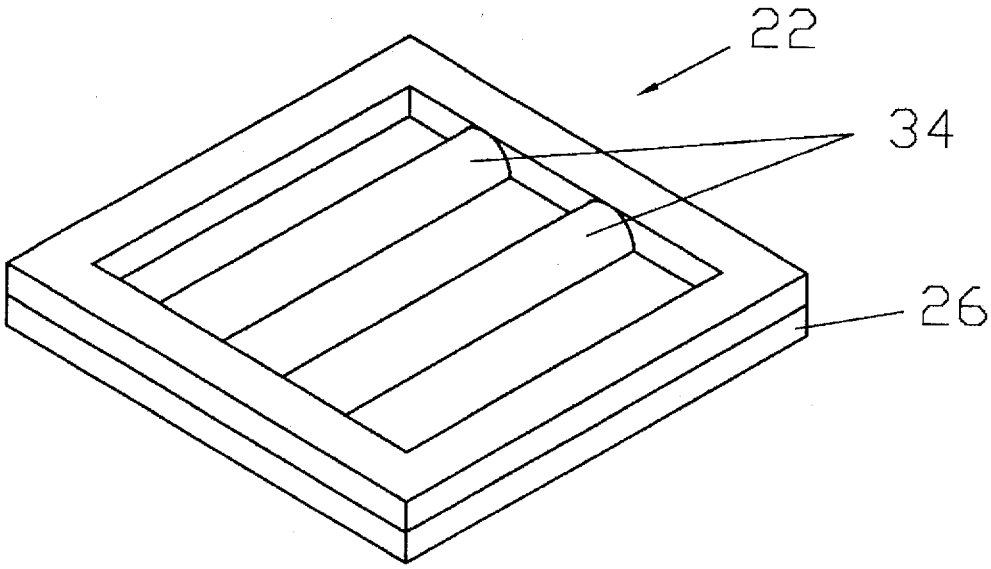
FIG. 2 is an isometric view of an alternative insulating spacer which can be used to maintain separation of a second electrode and a third electrode of a lamp such as is illustrated in FIG. 1.
Figure 3:
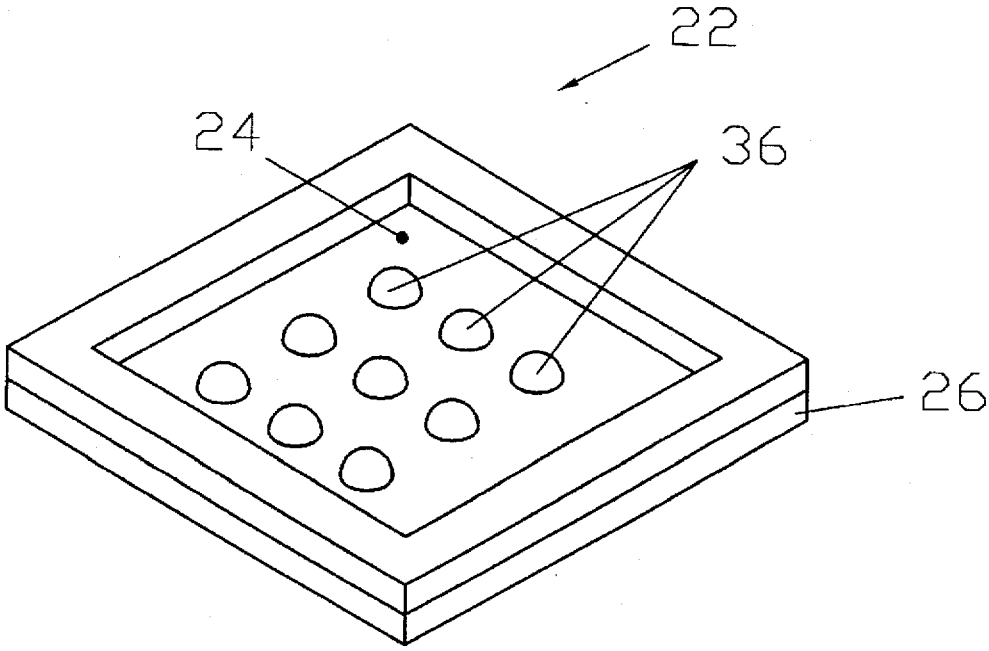
FIG. 3 is another embodiment of an insulating spacer suitable for use with a touch sensitive lamp such as shown in FIG. 1.

If the lamp 10 has a large cross-section or, alternatively, the elastic properties of the flexible transparent substrate 12 result in substantial deformation with small forces, then the insulating spacer 22 preferably includes additional supports such as illustrated in FIGS. 2 and 3. When additional supports such as ridges 34 are employed, these can be deposited onto the third electrode 26, and it is preferred that the surfaces be smooth. Such can be readily done by dispensing a stripe of ink which is fluid onto the third electrode 26, and allowing the surface tension to provide a smooth interface between the third electrode 26 and the ridges 34.

FIG. 3 illustrates an alternative embodiment of the insulating spacer 22 where the additional support is provided by an array of hemi-spherical caps 36, uniformly distributed across the open region 24 of the insulating spacer 22. These hemi-spherical caps 36 result from providing droplets of dielectric ink on the third electrode 26. The hemi-spherical caps 36 are supported on the third electrode 26.

Figure 4:
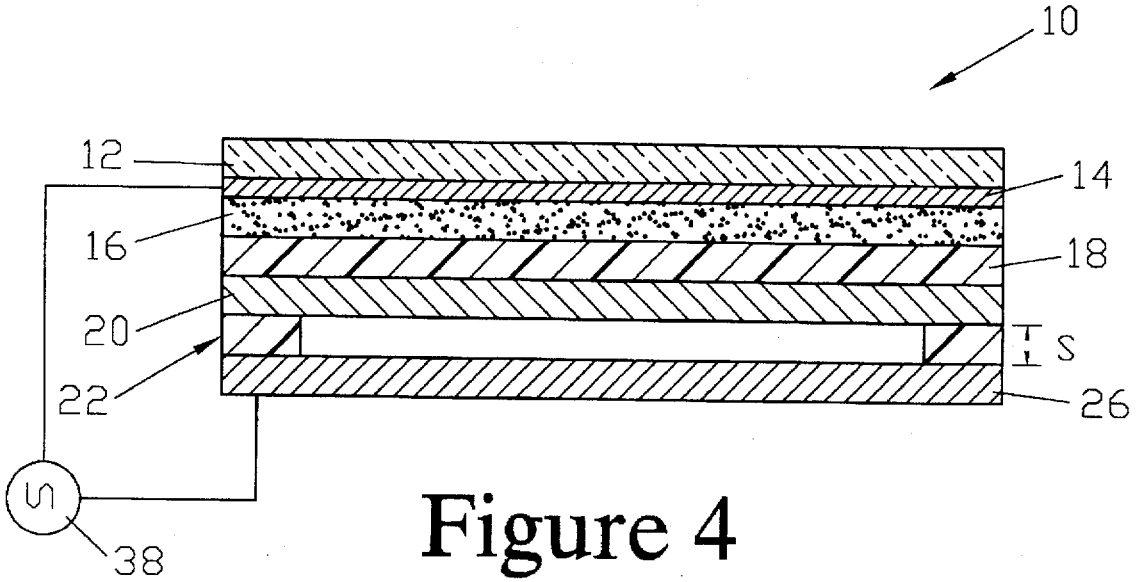
FIG. 4 is a section 4—4 of the assembled touch activated electroluminescent lamp of FIG. 1, which has a transparent electrode and a third electrode connected to an AC voltage source; however, as illustrated, its phosphor layer is not activated, since there is an intermediate second electrode and a gap between the phosphor and the third electrode.

FIG. 4 shows a section 4—4 of the assembled lamp 10 of FIG. 1, where the lamp 10 has a power supply 38 connected to the transparent electrode 14 and the third electrode 26. The lamp 10 is illustrated not illuminated, since there is a separation S between the second electrode 20 and the third electrode 26. This separation S prevents a potential from being established between the transparent electrode 14 and the second electrode 20. Without the force F being applied to the flexible transparent substrate 12, although an AC potential exists between the transparent electrode 14 and the third electrode 26, the intermediate structure, including the second electrode 20, prevents a field of sufficient strength to be maintained in the phosphor layer 16 to produce luminescence of the phosphor layer 16.

Figure 5:
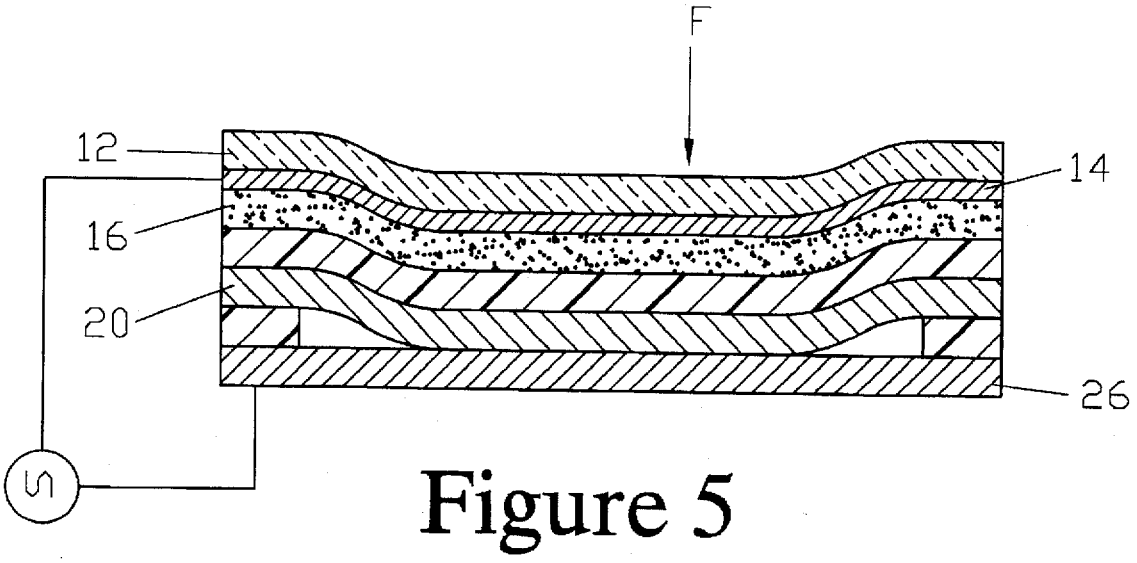
FIG. 5 is the section 4—4 of the lamp of FIG. 1 illustrating the lamp where a force has been applied to the transparent substrate, bringing the second electrode into contact with the third electrode, creating a voltage gradient in the phosphor layer and causing it to luminesce.

FIG. 5 illustrates the effect of the force F when applied to the flexible transparent substrate 12, bringing the second electrode 20 into contact with the third electrode 26. When the second electrode 20 makes contact with the third electrode 26, a potential is established between the transparent electrode 14 and the second electrode 20, generating a voltage gradient sufficient to cause luminescence of the phosphor layer 16. The preferred equilibrium separation S between the second electrode 20 and the third electrode 26 will depend on a variety of properties of the lamp 10, including the geometry as well as the properties of the layers. For example, holding all other factors constant, a greater separation S will be required when the elasticity of the flexible transparent substrate 12 is increased.

Figure 6:
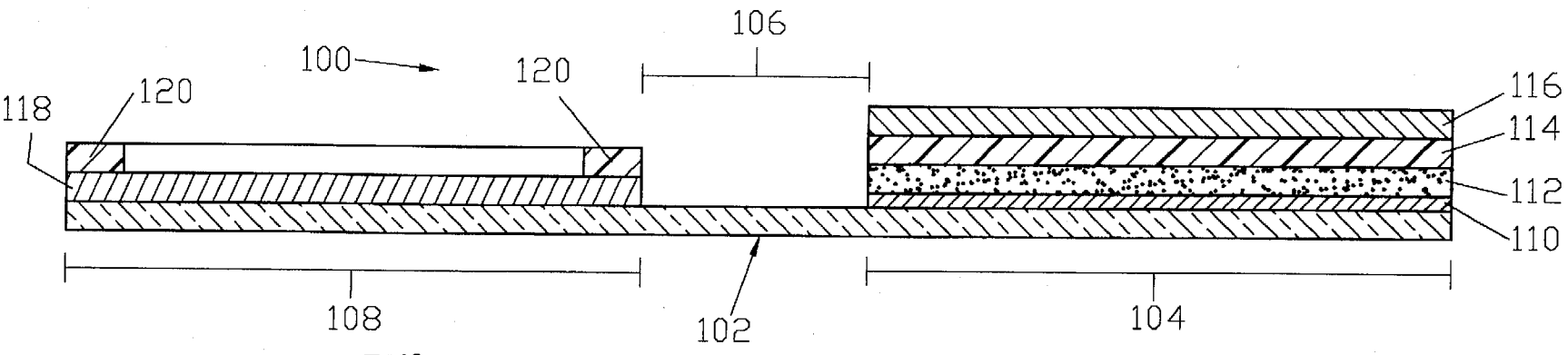
FIG. 6 is a view of a partially assembled touch sensitive lamp of another embodiment of the present invention. This embodiment is particularly well suited for screen printing, since all elements can be printed on a single side of a single transparent substrate. The lamp is shown after all printing steps have been performed.
Figure 7:
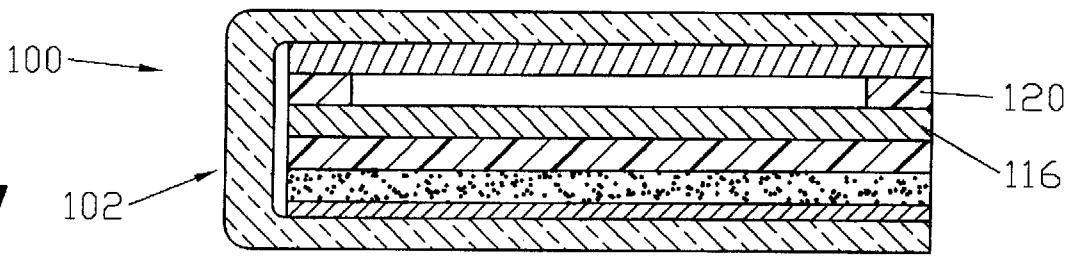
FIG. 7 is the lamp of FIG. 6 where the transparent substrate has been folded to complete the fabrication of the lamp.

FIGS. 6 and 7 illustrate another embodiment of a touch activated electroluminescent lamp 100 of the present invention, where all elements of the lamp 100 are screen printed onto a single sheet of flexible film 102. FIG. 6 illustrates the sheet of flexible film 102 having a front region 104, a hinge region 106, and a back region 108. In this embodiment, a transparent electrode 110 is screen printed onto the front region 104 of the flexible film 102. Thereafter, a phosphor layer 112 is printed onto the transparent electrode 110. A dielectric layer 114 is printed onto the phosphor layer 112, and a second electrode 116 is printed onto the dielectric layer 114. A third electrode 118 is printed onto the back region 108 of the flexible film 102, and an insulating spacer 120 is printed onto the third electrode 118. After the printing steps are complete, the back region 108 is folded onto the front region 104, and the insulating spacer 120 is brought into registry with the second electrode 116, providing the lamp 100 illustrated in FIG. 7. Manufacturing this embodiment of the invention is particularly desirable, since it allows all layers to be printed on a common substrate.

Figure 8:
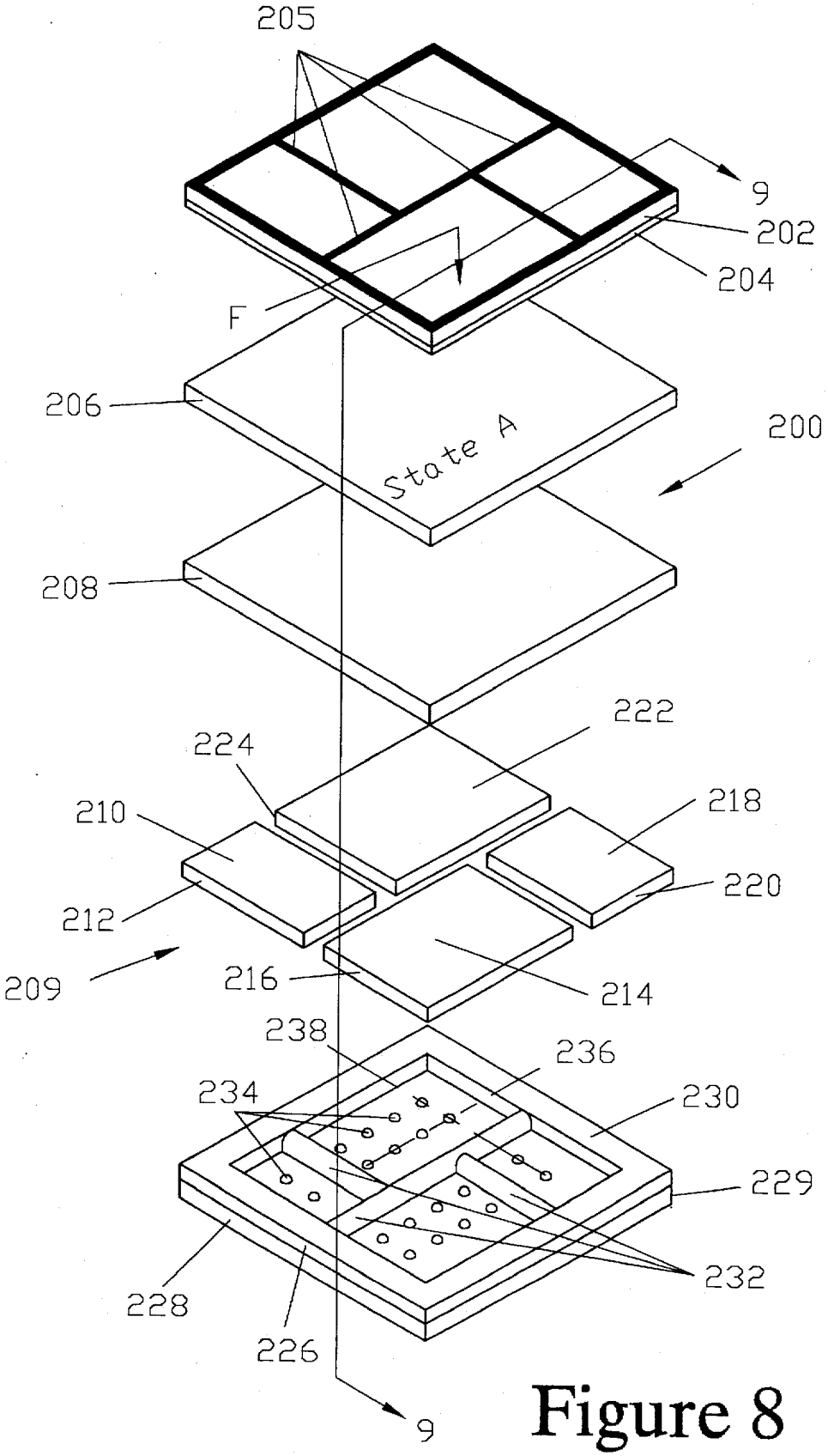
FIG. 8 is an embodiment of a touch activated electroluminescent display of the present invention. The display is shown as a partially exploded isometric view, illustrating a segmented second electrode and an insulating spacer having a central opening bounded by a frame. Ridges are provided within the frame, and these ridges follow the outline of the electrode segments. Also within the frame is an array of uniformly distributed isolated insulating bodies.
Figure 9:
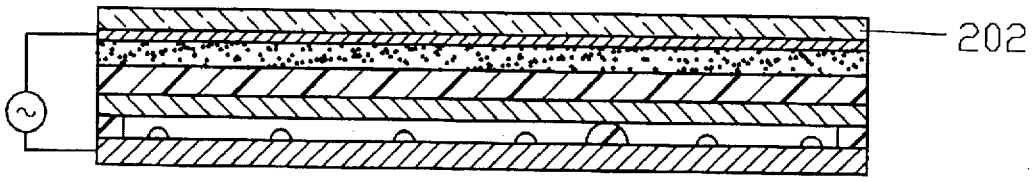
FIG. 9 is a section 9—9 of the assembled touch sensitive electroluminescent display of FIG. 8, and is shown connected to an AC voltage source. As illustrated, the lamp's phosphor layer has not been activated.
Figure 10:
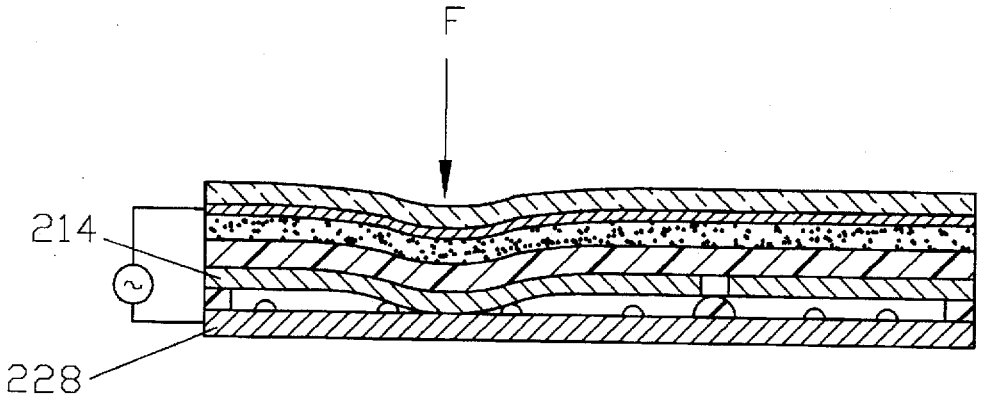
FIG. 10 is the section 9—9 of the display of FIG. 9 where a force has been applied to the transparent substrate, activating a region of the lamp.

FIGS. 8 through 10 are schematic representations of an electroluminescent touch sensitive display 200. This embodiment differs from the embodiments illustrated in FIGS. 1 through 7 in that this embodiment provides an electroluminescent display where selective regions of the display can be energized, causing segments of the display to be lighted. Such a display could be used as a teaching tool; for example, a map could be prepared where individual states were lighted as single regions. For each of these regions, part of the phosphor layer could be masked with the state's name, leaving the name dark when a field was applied to illuminate the state on the map. In this way, if one state of the map is touched, it would highlight the outline of the state and its name would be seen as a dark field.

FIG. 8 illustrates a partially exploded view of an electroluminescent display 200 of four hypothetical states on a map. The display 200 has a flexible transparent substrate 202, which has a transparent electrode 204 deposited thereon. The flexible transparent substrate 202 may contain information printed thereon, such as a boundary 205 of the hypothetical states.

A phosphor layer 206 is overlaid onto the transparent electrode 204. A dielectric layer 208 is deposited onto the phosphor layer 206. A segmented second electrode 209 overlays the dielectric layer 208. The segmented second electrode 209 has a first electrode segment 210 bounded by a first peripheral edge 212, a second electrode segment 214 bounded by a second peripheral edge 216, a third electrode segment 218 bounded by a third peripheral edge 220, and a fourth electrode segment 222 bounded by a fourth peripheral edge 224. The electrode segments (210, 214, 218, and 222) in this example are configured to the shape of the states they represent and will provide a lighted region of the map when the flexible transparent substrate 202 is touched. An insulating spacer 226 is provided which resides between the segmented second electrode 209 and a third electrode 228 having a perimeter 229. The insulating spacer 226 has a frame 230 which resides over the extended portion of the third electrode 228 in the vicinity of the perimeter 229 of the third electrode 228.

In the present embodiment, when the segmented second electrode 209 is employed, it is preferred that, in addition to the frame 230, ridges 232 are provided which follow the peripheral edges (212, 216, 220 and 224) of the electrode segments (210, 214, 218, and 222). These ridges 232 reduce the likelihood that there will be contact of an adjacent electrode segment by a force F applied to the element to be activated, even when the force is applied near the boundary of the region to be illuminated.

When additional support of the electrode segments beyond that provided by the frame 230 and the ridges 232 is desired, to maintain separation between electrode segments (210, 214, 218 and 222) of the segmented second electrode 209 and the third electrode 228, preferably there is provided an array of isolated insulating bodies 234, which are uniformly distributed along two sets of parallel rows with a first set 236 being normal to a second set 238. These isolated insulating bodies 234 can be readily formed by providing an array of insulating ink droplets on the third electrode 228. These isolated insulating bodies 234 reduce the chance of accidental activation and also will reduce the chance that the lamp will light if it is bent.

FIG. 9 illustrates a section 9—9 of the assembled display of FIG. 8. The display, as illustrated in FIG. 9, is in the inactive condition and no force has been applied to the flexible transparent substrate 202. FIG. 10 is the same section 9—9 as is illustrated in FIG. 9; however, the force F has been applied. This force F deforms the second electrode segment 214 and brings it in contact with the third electrode 228, as is illustrated.

Figure 11:
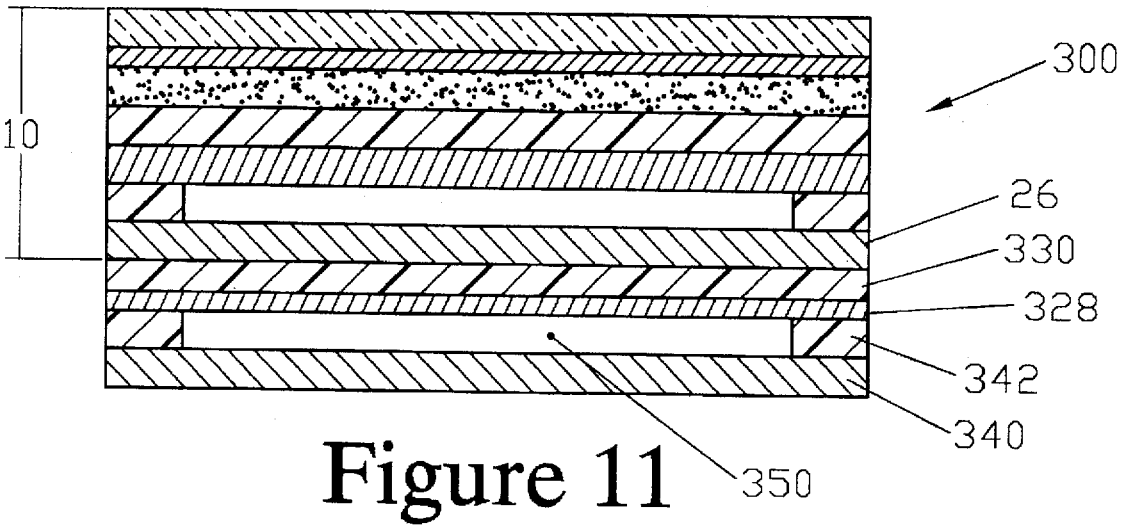
FIGS. 11 through 13 are sectional views of another embodiment of the lamp of the present invention, employing a second switch.

FIG. 11 is a cross-section of a two stage switch 300 of the present invention. The switch 300 has all the elements of the lamp 10 of FIG. 1 of the present invention. In addition to the above discussed elements, the two stage switch 300 has a fourth electrode 328 separated from the third electrode 26 by an insulating sheet 330. A fifth electrode 340 is also provided, with a second insulating spacer 342, having a second open region 350 therein, interposed between the fourth electrode 328 and the fifth electrode 340. When the fourth and fifth electrodes (328 and 340) form a contact switch, then the operation will be in a two stage mode as is illustrated in FIGS. 12 and 13.

Figure 12:
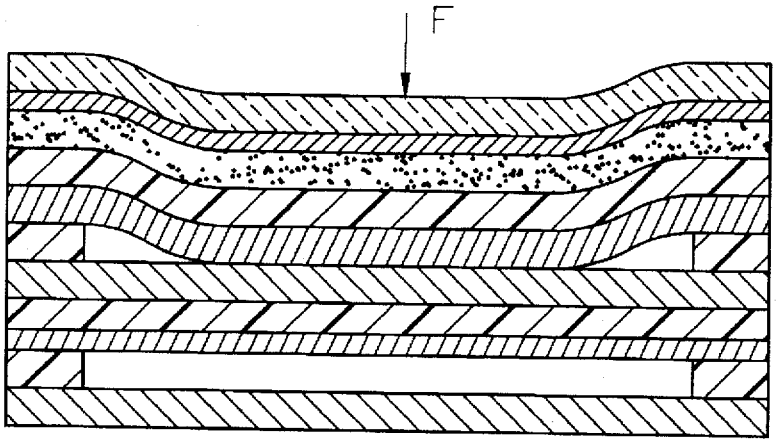
Figure 13:
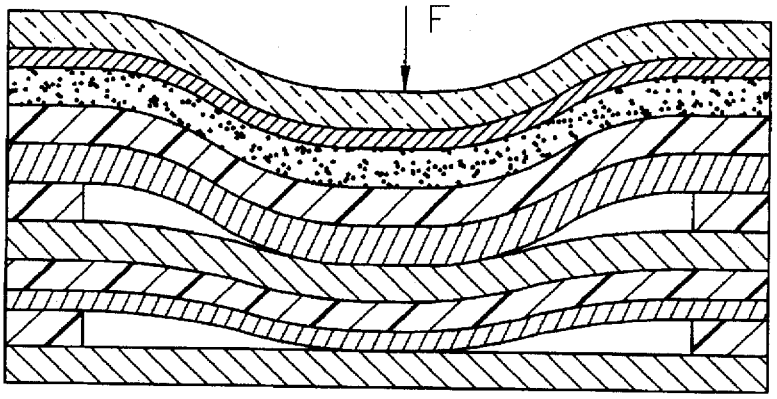

FIG. 12 illustrates the two stage switch 300 where the lamp 10 is energized by the force F and FIG. 13 illustrates the two stage switch 300 where the lamp 10 has been activated and the force F increased to activate the contact switch formed by the fourth and fifth electrodes (328 and 340).

What I claim is:

1. A touch activated electroluminescent lamp comprising:

a flexible transparent substrate;

a transparent first electrode deposited onto said transparent substrate;

a phosphor layer overlaying said transparent first electrode;

a dielectric layer overlaying said phosphor layer;

a second electrode overlaying said dielectric layer;

a third electrode spaced apart from said second electrode; and an insulating spacer having an open region, said insulating spacer interposed between said second electrode and said third electrode, said open region being configured to allow contact between said second electrode and said third electrode when pressure is applied to said flexible transparent substrate, said transparent first electrode and said second electrode serving to energize said phosphor layer when said second electrode contacts said third electrode.

2. The touch activated electroluminescent lamp of claim 1 wherein said insulating spacer has a frame bounding said open region and isolated insulating bodies affixed with respect to said frame and distributed therein.

3. The touch activated electroluminescent lamp of claim 2 wherein said isolated insulating bodies are affixed to said third electrode and contoured so as to provide smooth contact between said insulating bodies and said second electrode when said second electrode is in contact with said third electrode.

4. The touch activated electroluminescent lamp of claim 3 wherein said isolated insulating bodies are hemi-spherical caps uniformly distributed in an array, said isolated insulating bodies being arranged in a first set of parallel rows and a second set of parallel rows.

5. The touch activated electroluminescent lamp of claim 4 wherein said first set of parallel rows are orthogonal with respect to said second set of parallel rows.

6. A touch activated electroluminescent display comprising:

a flexible transparent substrate;

a transparent first electrode deposited onto said transparent substrate;

a phosphor layer overlaying said transparent first electrode;

a dielectric layer overlaying said phosphor layer;

a second electrode which is segmented, said segmented second electrode overlaying said dielectric layer, said segmented second electrode having at least a first electrode segment bounded by a first peripheral edge and a second electrode segment bounded by a second peripheral edge;

a third electrode spaced apart from said segmented second electrode; and an insulating spacer having an open region, said insulating spacer being interposed between said segmented second electrode and said third electrode and being configured to allow contact between said segmented second electrode and said third electrode when pressure is applied to said flexible transparent substrate, said transparent first electrode and said segmented second electrode serving to energize said phosphor layer when said second electrode contacts said third electrode.

7. The touch activated electroluminescent display of claim 6 wherein said insulating spacer further comprises:

a frame bounding said open region;

an array of isolated insulating bodies distributed within said frame and attached to said third electrode; and ridges residing within said frame and attached to said third electrode, said ridges aligning with said peripheral edge for each of said first and second electrode segments.

8. The touch activated electroluminescent display of claim 7 wherein said isolated insulating bodies are arranged in a first set of parallel rows and a second set of parallel rows.

9. The touch activated electroluminescent display of claim 8 wherein said first set of parallel rows is orthogonal to said second set of parallel rows.

10. The touch activated electroluminescent lamp of claim 3 further comprising;

a flexible film having a front region, a hinge region, and a back region;

wherein said transparent first electrode, said phosphor layer, said dielectric layer, and said second electrode are deposited onto said front region of said flexible film, said front region of said flexible film providing said transparent substrate; and wherein said third electrode and said insulating spacer with said isolated insulating bodies are deposited onto said back region of said flexible film; and said hinge region allowing folding of said front region with respect to said back region so that said second electrode is substantially parallel to said third electrode and is brought into registry with said insulated spacer.

11. The touch activated electroluminescent lamp of claim 1 further comprising:

a fourth electrode;

an insulating sheet separating said fourth electrode from said third electrode;

a fifth electrode; and a second insulating spacer separating said fifth electrode from said fourth electrode, said second insulating spacer having a second open region therein which is configured to allow contact between said fourth electrode and said fifth electrode when additional pressure is applied to said flexible transparent substrate.

12. The touch activated electroluminescent lamp of claim 3 wherein said isolated insulating bodies are ridges.

13. The touch activated electroluminescent display of claim 7 wherein said phosphor layer is a segmented phosphor layer, said segmented phosphor layer having at least a first phosphor segment which is coincident with said first electrode segment and a second phosphor segment which is coincident with said second electrode segment.

* * * * *